United States Patent [19]

Zwillinger

[11] 4,088,861

[45] May 9, 1978

[54] MICROWAVE OVEN WITH TORSION BAR HINGE

[75] Inventor: Daniel Zwillinger, New Boston, N.H.

[73] Assignee: McGraw-Edison Company, Elgin, Ill.

[21] Appl. No.: 667,892

[22] Filed: Mar. 18, 1976

[51] Int. Cl.[2] ..... H05B 9/06

[52] U.S. Cl. ..... 219/10.55 D; 126/191

[58] Field of Search ..... 126/191, 194, 200; 219/10.55 D

[56] References Cited

U.S. PATENT DOCUMENTS

| | | | |
|---|---|---|---|
| 3,263,674 | 8/1966 | Macaulay | 126/191 |
| 3,327,700 | 6/1967 | Macaulay | 126/191 |
| 3,373,733 | 3/1968 | Harrington et al. | 126/191 |

*Primary Examiner*—Arthur T. Grimley

[57] ABSTRACT

The invention relates to hinged supports using torsion bars for the doors of microwave ovens. For light-weight doors, the torsion bars extend beyond the sides of the doors and interlock with the oven structure to constitute the sole supporting means. For heavier doors, the torsion bars are provided with pivot shaft extensions mounted in bearings in the doors, which interlock with the oven structure. The torsion bars are preloaded to bias the doors closed in the light-weight door constructions, and operate in all cases to reduce the dead weight of the doors when in their open, horizontal positions. The side extensions interlockingly engage brackets in the oven structure aided by the weight of the doors, and permit the doors to be lifted readily therefrom.

Although the invention is especially useful and is herein particularly described in connection with microwave ovens, no unnecessary limitation thereto is intended because this invention has application also to other appliances such as conventional ovens, dishwashers, etc.

13 Claims, 12 Drawing Figures

FIG. 1
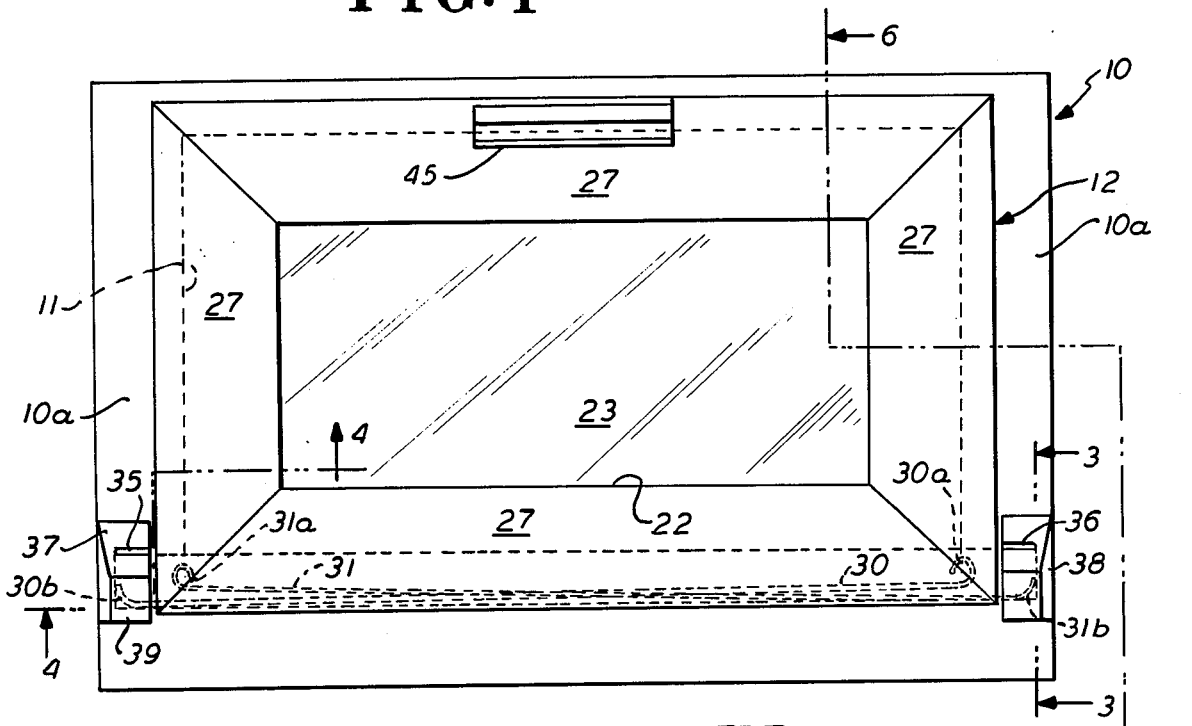
FIG. 2
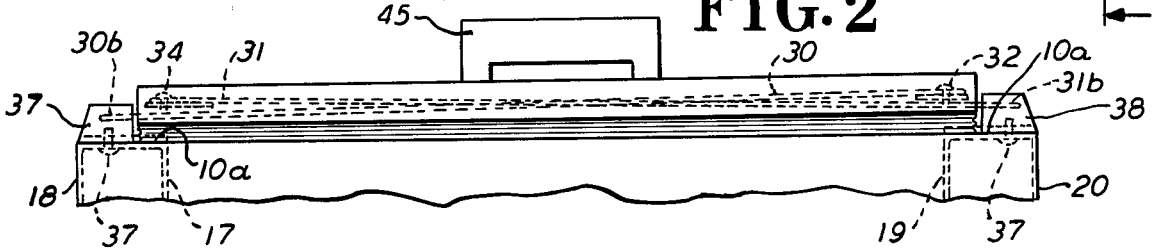
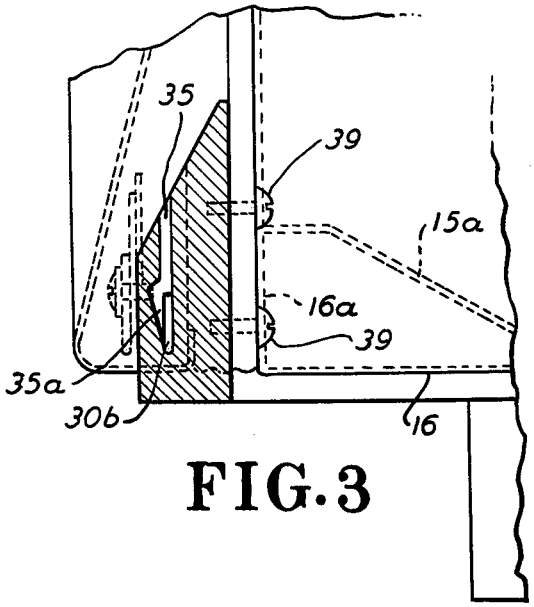
FIG. 3
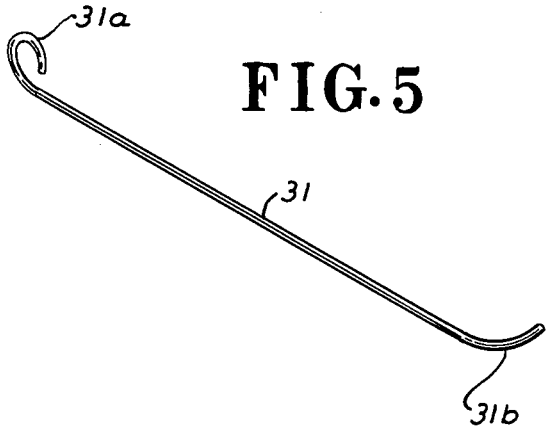
FIG. 5

FIG.9
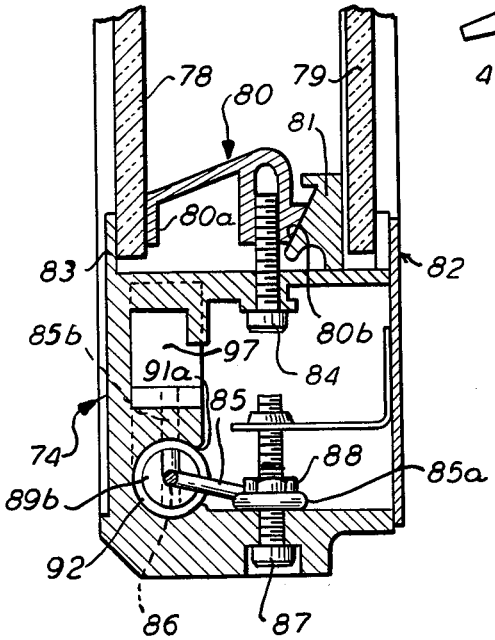
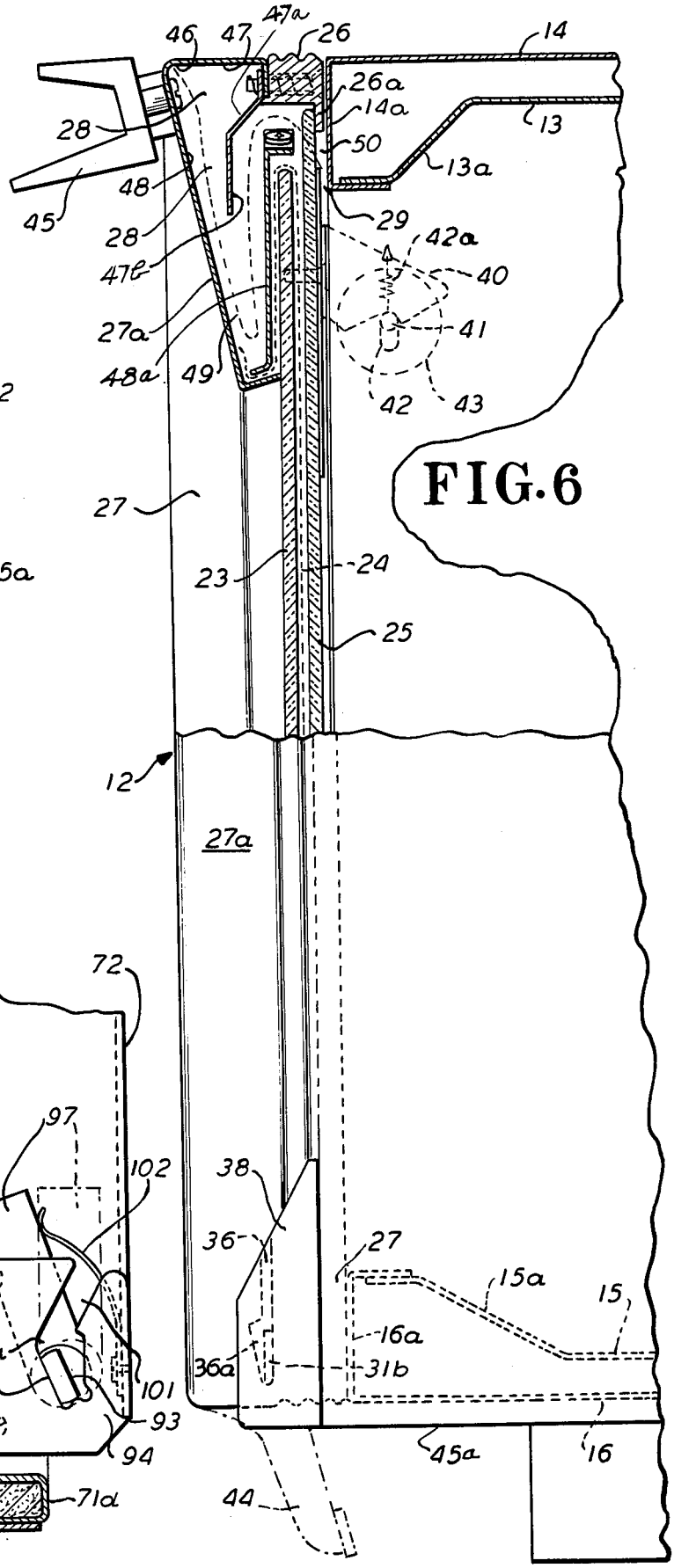
FIG.6
FIG.10
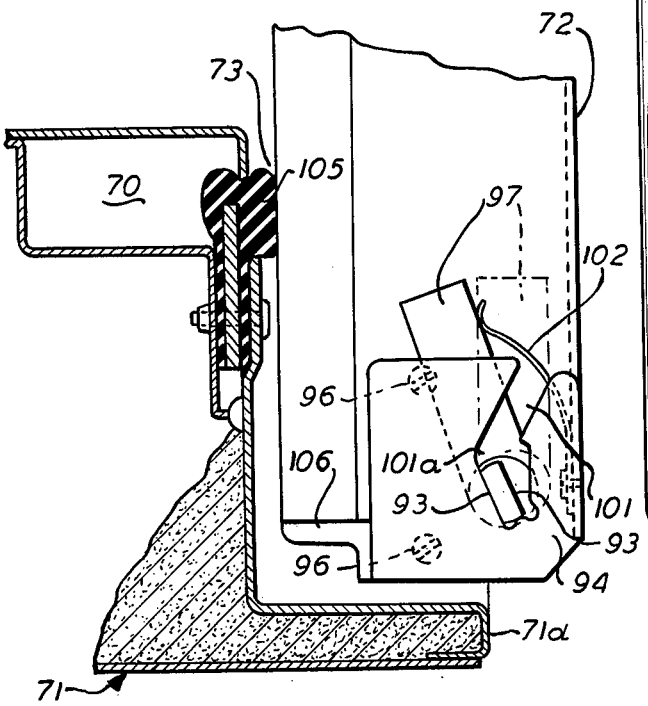

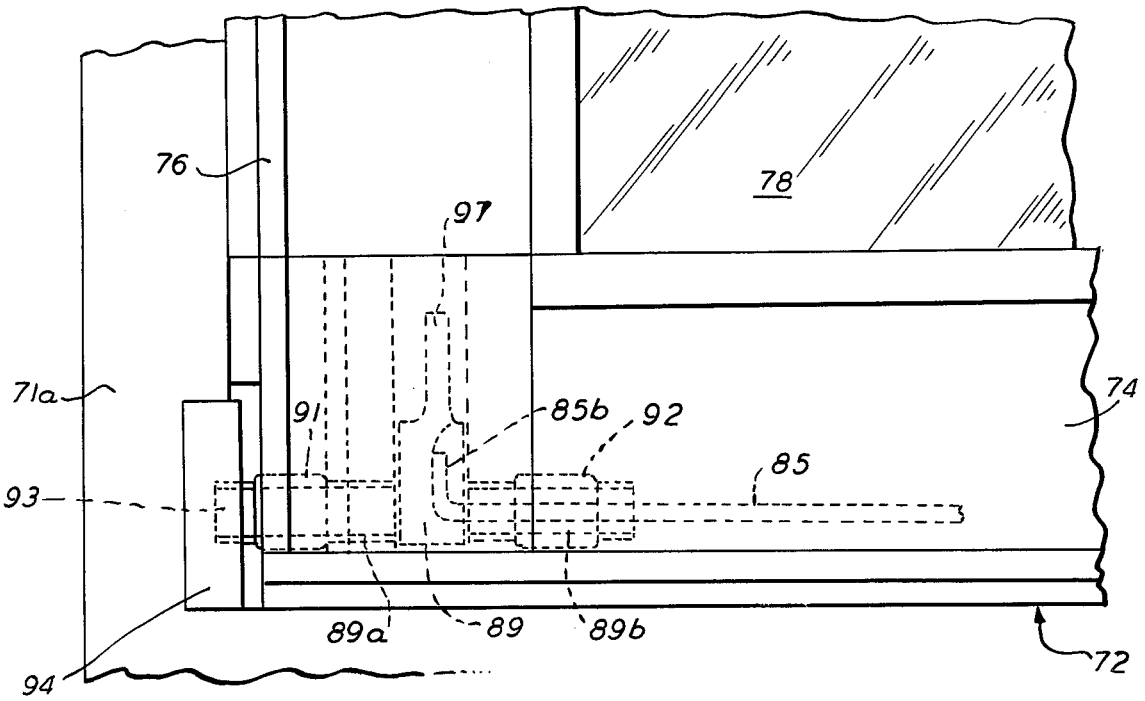
FIG. 11
FIG. 12
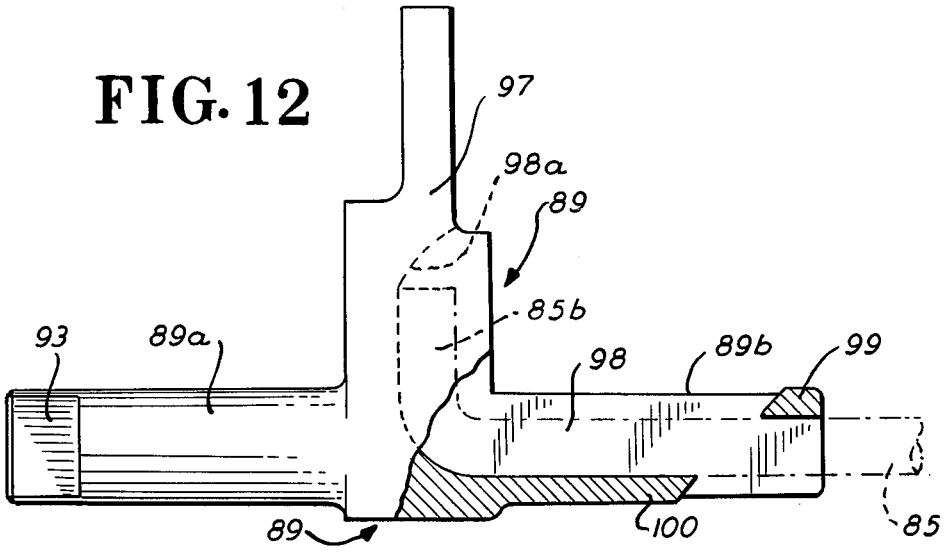

MICROWAVE OVEN WITH TORSION BAR HINGE

An object of the invention is to provide novel hinged supports for the doors of microwave ovens and similar appliances, which are of compact, simple, and low-cost design.

Another object is to provide such hinged supports using torsion bars which in view of their not undergoing dimensional changes or requiring displacement space as the doors are opened and closed, can be compactly mounted and concealed to permit microwave chokes to be readily incorporated to seal the gaps between the doors and ovens.

Another object is to provide such improved hinged supports for appliances wherein the torsion bars bias the doors closed and/or to reduce the dead weight of the doors when the doors are open, and wherein the torsion bars may constitute the sole supporting means for the doors.

Another object is to provide such hinged supports wherein torsion bars mounted in compact arrangement within the door structures permit the doors to have continuous, smooth outer surfaces which can be kept readily clean.

A further object is to provide hinged supports for the doors of microwave ovens wherein torsion bars concealed in the door structures are connected to pivot shafts which are mounted in bearings in the side walls of the doors and which are secured at their outer ends in mounting brackets in the oven structure.

Another object is to provide such hinged supports wherein the pivot shafts have radial arms engageable with rest plates of the door structure as the door is opened to locate the doors in their open positions, and wherein the pivot shafts have rockable engagement with the support brackets in the oven structure to displace the fulcrum as the door is opened and closed whereby to reduce clearance problems between the door and oven frame as the door is opened and to provide closing pressure of the door against the oven frame as the door is closed.

A further object is to provide hinged supports for the doors of microwave ovens wherein torsion bars concealed in the door structure seat releasably in mounting brackets in the side walls of the oven to permit the doors to be readily lifted and removed therefrom.

These and other objects and features of the invention will be apparent from the following description and the appended claims.

In the description of my invention, reference is had to the accompanying drawings, of which:

FIG. 1 is a front elevational view of a small microwave oven having a light-weight door with torsion bars providing both a hinge and the support for the door:

FIG. 2 is a fractional bottom plan view of the oven and door shown in FIG. 1:

FIG. 3 is a vertical fractional sectional view to larger scale of one hinge taken on the line 3—3 of FIG. 1:

FIG. 5 is a perspective view of one of the torsion bars:

FIG. 6 is a lefthand partly sectional view of the door and front portion of the oven taken on the line 6—6 of FIG. 1, showing the door with a molding incorporating a microwave doorseal choke to seal the oven against loss of microwave energy through gaps between the door and oven:

FIG. 9 is a fractional vertical section on the line 9—9 of FIG. 7:

FIG. 10 is a fractional vertical section on the line 10—10 of FIG. 7:

FIG. 11 is an enlarged corner view of the door showing more particularly the shaft member connected to the end of the torsion bar; and FIG. 12 is a side elevational view of the shaft member per se.

Figure 4:
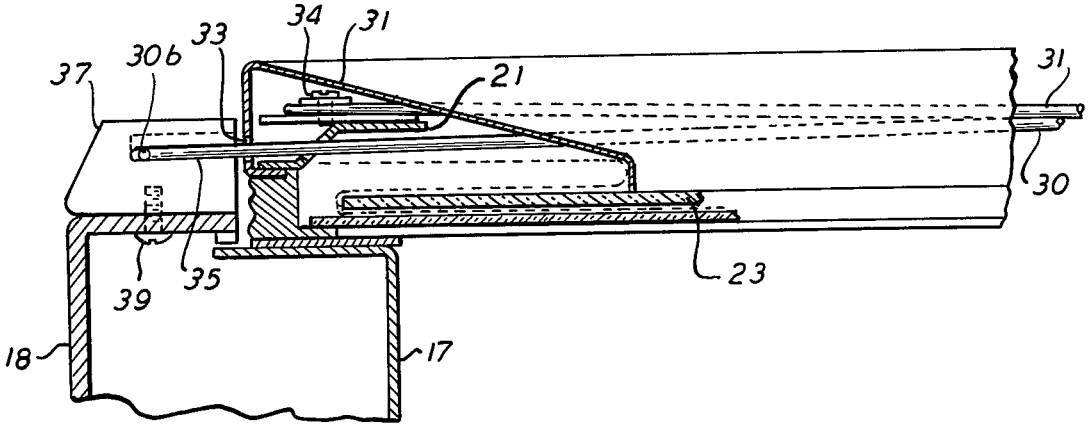
FIG. 4 is a horizontal fractional view of one hinge with parts in section on the line 4—4 of FIG. 1.

The microwave oven shown in FIGS. 1–6 comprises a rectangular oven structure 10 having an opening 11 at its front end surrounded by a trim **10*a* and closed by a hinged door 12. Each side of the oven comprises inner and outer metal walls spaced from each other for providing better insulation. The top side of the oven comprises inner and outer walls 13 and 14, and the bottom side inner and outer walls 15 and 16 shown in FIG. 6; and the left side comprises inner and outer walls 17 and 18 and the right side inner and outer walls 19 and 20 shown in FIG. 2. The outer walls of the sides have flanges at the open end of the oven which form a front trim 10*a* for the oven and also a wide seating surface at the inner side of the trim for the door. These flanges are bent inwardly at their inner edges and are welded to the respective inner walls as indicated in FIG. 6**.

Since the walls of the top and bottom sides of the oven are spaced at a lesser distance apart than the width of the front trim, the inner walls are flared inwardly so as to meet the inner edges of the trim as shown in FIG. 6.

The door 12 comprises a rectangular frame having a central rectangular opening 22 closed by a heavy glass pane 23 which overlaps partially the inner wall of the frame. The back side of the pane 23 is covered by a shielding screen 24 (FIG. 6). Overlying this screen is a second glass pane 25 as of tempered lime glass which extends past the heavy pane 23 to an aluminum bead 26 secured to the rim of the frame. This bead has an inwardly extending lug **26*a* embracing the edge of the inner pane to hold the panes in place. The frame comprises hollow panel molding strips 27 cut at 45° and welded into an integral rectangular structure. The panel moldings have a receding front wall 27*a* providing a decorative appearance and forming a choke cavity 28 therein of a shape to seal the microwave energy in the oven against leakage via a gap 29** between the door and the open end of the oven as is hereinafter more particularly described.

In the outer portion of the bottom molding strip of the door frame there are two torsion bars 30 and 31 running laterally of the oven through approximately the length of the door (FIGS. 1 and 2). These torsion bars have eyes **30*a* and 31*a* at their inner ends formed by a spiral bending of the end portions of the torsion bars to avoid stress concentrations in the bars when the bars are subjected to a twisting deformation. The torsion bar 31 is secured at the lower left corner portion of the door to a bracket 21 in the panel molding by a bolt 34 passing through the eye 31*a*. From this point the bar extends to the right along the outer wall of the molding and beyond the left side of the door through a clearance opening in the right wall of the door. The torsion bar 30 is secured likewise to the lower right corner portion of the door by a bolt 32 and extends to the left along the outer wall of the molding and beyond the door through a clearance opening 33 in the left wall thereof (FIG. 4). The outer end portions 30***b* and 31*b* of the torsion bars 30 and 31 are bent at right angles again in spirals to avoid stress concentrations. These outer end portions seat in slots 35 and 36 provided in respective wedge-shaped brackets 37 and 38 secured by screws 39 to the front trim of the oven at the sides of the door. The slots 35 and 36 extend vertically from the top slanted faces of the brackets 37 and 38 and rest in the bottom portions of the slots by the weight of the door (FIG. 3). These bottom portions of the slots are notched outwardly at 35*a* and 36*a* (FIGS. 3 and 6) so that when the door is opened the right angle portions 30*b* and 31*b* of the torsion bars will become latched in the slots against outward displacement. When the door is closed these right angle extensions of torsion bars are moved back in line with the slots, permitting the doors to be then lifted vertically to disengage the torsion bars from the brackets. In this microwave oven construction wherein the doors are relatively light in weight, the integral torsion bar extensions constitute the sole support for the oven door. The torsion bars are secured tightly to the door by the bolts 32 and 34 so that they support the full weight of the door without any sagging of the door. However, bearings are in effect provided by the clearance openings in the side walls of the door through which the torsion bars pass to limit any displacement of the door from its true rotational axis due to any sudden thrust exerted on the door as it is opened and closed. A handle 45 is at the top of the door for opening and closing the same.

The torsion bars may be prestressed so that they serve to bias the door closed. In this case the torsion bar extensions will engage the bottom notched portions 35*a* and 36*a* of the slots 35 and 36 in locking positions. When the bars are not prestressed, the door is held closed solely by a suitable latch at the top which may comprise a catch member 40 on the side wall of the door (FIG. 6) and a cooperating latch pin 41 extending laterally from the side of the oven through a clearance slot 42. The latch pin is biased vertically as by a spring 42*a* to permit the door to be pressed into latched position as shown in FIG. 6. Release of the catch may be effected by a solenoid 43 mounted in the space between the oven walls. In any case, whether the torsion bars are prestressed or not, the bars undergo a twisting deformation and so become spring-loaded as the door is opened to reduce the effective dead weight of the door. This spring-loading may be made sufficient to support the door horizontally when the door is open. However, the counterforce from spring-loading of the torsion bars is preferably made somewhat less than that required to support the door, and the open position of the door is then defined by a suitable stop 44 on the door which engages the underside 45*a* of the oven to locate the door positively when the door reaches a horizontal open position.

The torsion bars are unique in that they undergo no extension as they are spring-loaded, and require therefore no extra empty space normally requiring slots, linkages, cavities or bulges in the door construction. The use of torsion bars is therefore an aid in enabling the choke cavity 28 before referred to to be provided within the panel molding 27. In the design of the choke cavity, the panel molding is made to a size and shape according to Maxwell's equations determining boundary conditions and phase characteristics of microwave electric and magnetic energy whereby the microwave energy is sealed against loss through any gaps between the door and oven.

The microwave choke is represented by the cavity defined by the curved conductor surface 46 opposite the flat conductor surfaces 47, 47*a* and 48; and the resistance is determined by the dielectric properties of the cavity between these surfaces. An original inductive end or electric short is induced in the cavity concentrated in the induced electromagnetic field at the curved surface 46, and its image occurs at intervals of one-half wavelength along a mean line 49 for phase shift. By proper design, the area 50 at the gap 29 can be made to be an integral number of one-half wavelength along the mean line 49 from the original inductive end 46 to reflect an electric short in this area where no conductors are touching, whereby to seal any loss of microwave energy via the gap 29.

In FIGS. 7–12 there is shown a modified oven door arrangement incorporating a choke cavity 70 in the oven structure 71 and a different embodiment of door hinge in the door assembly 72 adapted especially for supporting heavy doors. The oven is outwardly of the same appearance as the first embodiment, having a front trim 71*a* with the rim thereof around the oven opening overlapped by the door. Any gap 73 between the door and oven is sealed by the oven choke in the manner hereinbefore described with respect to the first embodiment of FIGS. 1–6.

Figure 7:
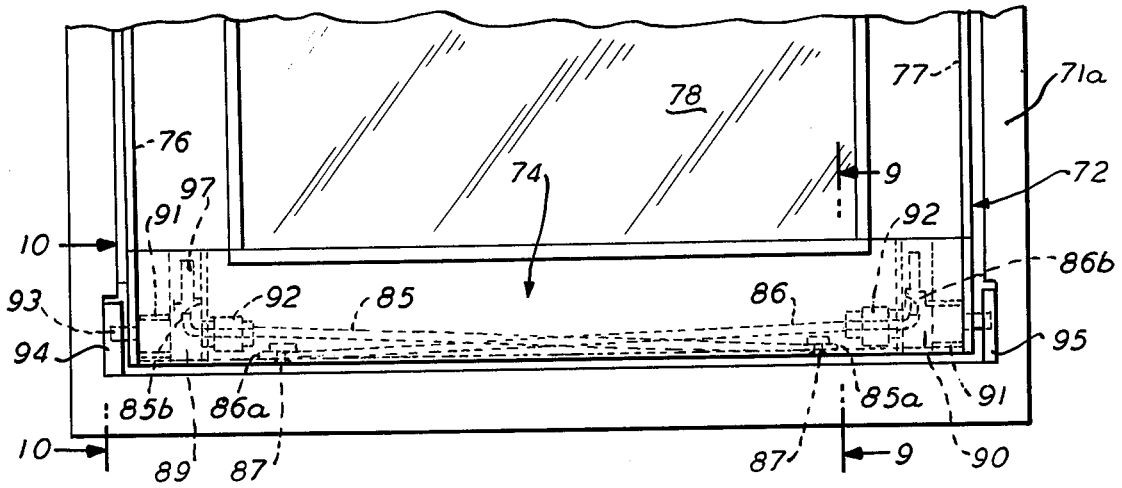
FIG. 7 is a fractional front plan view of another embodiment of the invention wherein the door mounting comprises separate shaft extensions on the torsion bars mounted in bearings provided in the door structure.

The door assembly 72, which is fabricated from aluminum extrusions without use of panel molding, is of uniform thickness having a top extrusion incorporating a latch not herein shown, and having a bottom extrusion 74. These extrusions are joined by heavy side walls 76 and 77 (FIGS. 7 and 11), and the front and back sides of the door are closed by heavy glass panes 78 and 79 (FIGS. 7 and 9). These panes are secured firmly in place at the top and bottom by clamping means of which that for the bottom is shown for example in FIG. 9 as comprising a clamp member 80 having a foot 80*a* bearing at one end against the pane 78 and having an inclined cam face 80*b* at the other end bearing against a corresponding face of a strip bead 81 contacting the pane 79, whereby to press the panes firmly against upstanding side flanges 82 and 83 in the bottom extrusion as the clamp member 80 is tightened by a screw 84 passing through the top wall of the bottom extrusion.

Figure 8:
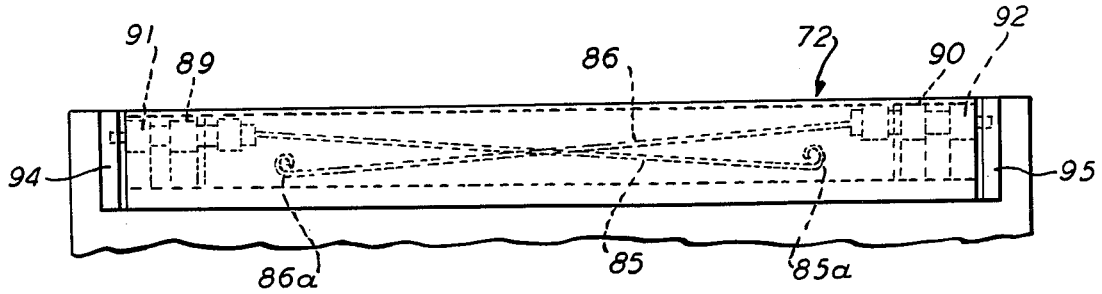
FIG. 8 is a fractional bottom plan view of this second embodiment.

In the lower part of the bottom extrusion there are two torsion bars 85 and 86 having eyes 85*a* and 86*a* secured respectively at opposite sides of the door by nuts 88 and by bolts 87 passing through the bottom wall of the extrusion 74 midway of the thickness thereof (FIG. 9). The torsion bars extend respectively in opposite directions along the door towards the opposite sides thereof and are slightly forwardly inclined to terminate adjacent the front wall of the door. The end portions of the torsion bars terminate in right-angle tips 85*b* and 86*b* which are again bent on spiral curves to avoid concentrated stresses (FIGS. 7, 8, and 9). These right-angle tips engage respective shaft members 89 and 90 having outer shaft extensions 89*a* and 90*a* and inner shaft extensions 89*b* and 90*b* mounted in bearings 91 and 92 in the door assembly and provided with tips extending beyond the bearings having diametrically opposite flats 93 thereon for locking engagement with brackets 94 and 95 at the opposite sides of the door secured to the oven structure by screws 96 (FIG. 10). The shaft members are slipped sidewise into bearing holes via side openings 91*a* shown in FIG. 9 after which the bearings are slipped on the shaft members lengthwise thereof into the bearing holes.

Each shaft member has a radial arm 97 midway the length thereof from one side of which extend the shaft extensions 89*a* and 90*a* aforementioned and from the other side of which extend shaft extensions 89*b* and 90*b* (FIG. 12). The shaft extensions 89*b* and 90*b* have slots 98 lengthwise thereof which run radially at 98*a* through a portion of the arm 97 to receive the right-angle tips 85*b* and 86*b* of the torsion bars in locking engagement against rotation relative to the shaft members 89 and 90. The slots 98 have a top bridge 99 at the outer end of the shaft extensions 89*b* and 90*b* which is spaced lengthwise of the shaft from the end of the wall 100 constituting the bottom of the slot so that the torsion bars with the right-angle tips can be threaded into the slot and when then swung into line with the shaft member will be in locking engagement with the shaft.

The flattened tips 93 of the shaft extensions 89*a* and 90*a* engage slots 101 in the brackets 94 and 95 which extend downwardly and inwardly from the top of the bracket through a first portion of the length thereof (FIG. 10) and then curve downwardly and forwardly through the remaining bottom portion 101*a* thereof. This bottom portion 101*a* receives the first extensions in a resting position to support the weight of the door. The walls of this bottom portion of the slots are flared away from each other to permit the shafts 89 and 90 to pivot on the bottom of the slots 101*a* with a rocking motion. Further, the arm 97, which stands upright relative to the door, is biased inwardly as by a cantilever spring 102 between the front wall of the door and the arm as shown in FIG. 10. When the door is closed the spring 102 presses the arm 97 in a rearwardly-inclined position until the back flattened face of the tip 93 of the shaft member bears flat against the rear edge of the flared portion 101*a* of the slot 101 to thereby shift the door rearwardly and bring pressure of the door against a gasket 105 to seal more effectively the door to the oven. When the door is opened, the arm follows the same in its initial opening movement until the front flattened face of the tip 93 engages the forward edge of the flared portion of the slot 101*a*, at which point the arm stands upright in the dotted position shown in FIG. 10. As the door reaches its horizontal open position, a rearward arm 106 of the door comes to bear against the arm 97 to locate the door positively in its open position.

The embodiments of my invention herein particularly shown and described are intended to be illustrative and not necessarily limitative of my invention since the same is subject to changes and modifications without departure from the scope of my invention, which I endeavor to express according to the following claims.

I claim:

1. In a microwave oven or like appliance: the combination of a structure having a chamber therein provided with an opening at one end, a door for said opening, and a hinge support for said door comprising a pair of torsion bars running parallel with the hinged end of the door, means rigidly securing one end of each torsion bar to the inner structure of the door, said torsion bars having shaft means extending beyond opposite sides of the door at the rotational axis of the door, and bracket members in side walls of said chamber structure receiving said shaft means in non-rotational engagement therewith whereby said torsion bars are subjected to a twisting deformation as said door is swung between open and closed positions for spring-loading the door.

2. The microwave oven or like appliance as set forth in claim 1 wherein said torsion bars are prestressed prior to their engagement with said bracket members to provide a bias force tending to hold said door closed.

3. The microwave oven or like appliance as set forth in claim 1 wherein said torsion bars extend through the major length of the door in overlapping relation to each other and said torsion bars have curved portions of a spiral form at the ends thereof.

4. The microwave oven or like appliance as set forth in claim 1 wherein said shaft means are members separate from said torsion bars and detachably interlockingly engaged therewith, including bearings in said door structure for said shaft members.

5. The microwave oven or like appliance as set forth in claim 4 wherein said torsion bars have spiral inner end portions forming eyes, including bolts passing through said eyes and tightened to the door structure to secure the inner ends of the torsion bars thereto, and wherein the outer ends of said torsion bars terminate in right-angle bends on a spiral in interlocking engagement with said shaft members.

6. The microwave oven or like appliance as set forth in claim 4 wherein said shaft members are provided with radial arms and said door has cooperating rest plates engaged by said radial arms as the door is opened to locate the door in a horizontal open position.

7. The microwave oven or like appliance as set forth in claim 6 wherein said shaft members have flattened end portions and said slots have lower V-shaped portions receiving said flattened end portions to permit rocking movement of the shaft members with a fulcrum displacement of the shaft members to and from said chamber, including means for latching said door closed, and spring members between said radial arm and a wall of the door for rocking said shaft members to displace the hinged end of the door inwardly into a tight closing engagement with the chamber structure as the door is latched closed.

8. The microwave oven or like appliance as set forth in claim 4 wherein said shaft members have flattened end portions and said bracket members have vertical slots receiving said flattened end portions to restrict rotational freedom thereof with the shaft members being retained in the bracket members aided by the weight of the door while permitting the door to be lifted therefrom for detachment from the chamber structure.

9. The microwave oven or like appliance as set forth in claim 1 wherein said chamber is heated by microwave energy of a prescribed frequency, and said door has a choke cavity open to said chamber via a gap between the door and chamber structure, said choke cavity having an inner curved conductor surface opposite a pair of flat conductor surfaces to induce an electric short concentrated in the induced electromagnetic field of said cavity at its inductive end, said choke cavity being shaped so that said inductive end and said gap are at a distance apart equal to an integral multiple one-half wavelength of said microwave energy to induce an electric short at said gap.

10. The microwave oven or like appliance as set forth in claim 9 wherein said door is provided with a panel molding along the edges thereof to provide said choke cavity therein, wherein torsion bars are concealed in the bottom strip of said panel molding and extended along the length of said strip to said door at the bottom corners thereof and being extended respectively to the opposite corners thereof, and means at the outer ends of said torsion bars extending through the respective walls of said door in interlocking engagement with the adjacent wall portions of the oven whereby the door is spring-loaded by said torsion bars.

11. In a microwave oven or like appliance: the combination of a structure having a chamber therein provided with an opening at one end, a door for said opening, and a hinge support for said door comprising a pair of torsion bars running parallel with the hinged end of the door, means rigidly securing one end of each torsion bar to the inner structure of the door, said torsion bars having shaft means extending beyond opposite sides of the door, and bracket members in side walls of said chamber structure receiving said shaft means in non-rotational engagement therewith whereby said torsion bars are subjected to a twisting deformation as said door is swung between open and closed positions for spring-loading the door, and wherein said shaft means comprise integral extensions of said torsion bars and said torsion bars provide the sole hinge support for said door.

12. The microwave oven or like appliance as set forth in claim 11 wherein said door has clearance openings for said torsion bars to limit displacement of the door from its hinged axis should the door be shifted between open and closed positions by a thrust force.

13. The microwave oven or like appliance as set forth in claim 11 wherein said torsion bars are in the lower part of the door and are spring-loaded as the door is opened for reducing the lifting weight of the door when the door is in its horizontal open position.

* * * * *